US005611824A

United States Patent [19]

Stephens

[11] Patent Number: 5,611,824

[45] Date of Patent: Mar. 18, 1997

[54] FULLERENE JET FUELS

[75] Inventor: William D. Stephens, Huntsville, Ala.

[73] Assignee: The United States of America as represented by the Secretary of the Army, Washington, D.C.

[21] Appl. No.: 668,030

[22] Filed: Jun. 18, 1996

Related U.S. Application Data

[63] Continuation-in-part of Ser. No. 578,005, Dec. 22, 1995, abandoned.

[51] Int. Cl.[6] ..... C10L 1/00

[52] U.S. Cl. ..... 44/282; 44/281; 585/14

[58] Field of Search ..... 44/281, 282

[56] References Cited

U.S. PATENT DOCUMENTS

| | | | |
|---|---|---|---|
| 5,234,475 | 8/1993 | Malhotra et al. | 44/282 |
| 5,258,048 | 11/1993 | Whewell | 44/282 |
| 5,341,639 | 8/1994 | Stephens | 60/204 |
| 5,454,961 | 10/1995 | Schriver et al. | 252/45 |
| 5,462,680 | 10/1995 | Brois et al. | 252/9 |
| 5,503,643 | 4/1996 | Schriver et al. | 44/282 |

*Primary Examiner*—Jacqueline V. Howard

*Attorney, Agent, or Firm*—Hugh P. Nicholson; Freddie M. Bush

[57] ABSTRACT

This invention involves a process for achieving more energetic fuels by using high density fullerenes and fullerene derivatives, mixed with liquid hydrocarbon or hydrocarbon derivative fuels. The advantages of the these materials are that they constitute a form of high density carbon which will evaporate or sublime quite easily by comparison to particles of carbon. The fullerenes, or derivatives of fullerenes, exist as molecules which are relatively volatile. These materials are generally solids and therefore easily compounded into hydrocarbon fuels slurries. The derivatives can be tailored for high solubility in hydrocarbon solvents. In addition, the fullerenes can be modified easily to adjust the oxidization susceptibility so that the residence time in the combustion zone can be shortened even further.

7 Claims, No Drawings

FULLERENE JET FUELS

This application is a continuation-in-part of application Ser. No. 08/578,005, filed 22 December 1995, now abandoned.

The invention described herein may be manufactured, used, and licensed by or for the Government for governmental purposes without the payment to me of any royalties thereon.

Hydrocarbon fuels have been used with air breathing engines such as jet engines, turbojets, pulse jets, ram jets, scram jets, and other engines used for aircraft and missile propulsion. The composition of these jet fuels is carefully tailored to provide maximum energy per unit weight or per unit volume, and to achieve other desired characteristics. Hydrocarbon mixtures have typically been used.

One of the desired characteristics for fuels of this type is to have density values as high as possible in order to achieve greater weight per unit volume and therefore greater calorie content or energy per unit volume. Typically, density values for hydrocarbons run from approximately 0.8 to approximately 0.95 grams per milliliter. These values are quite low and efforts have been made to increase the density values by including higher density additives mixed in with the hydrocarbon fuels. Because carbon has high heat content, and therefore high energy content, and a relative high density (density values for carbon run from approximately 1.5 to 1.8 grams per milliliter), efforts have been made in the past to increase the energy content per unit volume of these fuels by preparing slurries of carbon particles in the hydrocarbon jet fuel carrier. In general, these efforts have been unsuccessful because of the difficulty of obtaining complete combustion of the carbon particles. Carbon particles require a long residence time in the combustor because first, the particle must be heated to a high temperature, and then effective collisions with oxygen in the air must occur eroding the particle from the "outside-in" until it is completely burned.

The objectives of increasing the energy per unit volume by increasing the density of the fuel could be met by mixing a high density material additive with the hydrocarbon carrier. Furthermore, if the additive were a crystalline solid suspended in the hydrocarbon slurry, had a high density, and if the additive transitioned to a vapor phase molecule in the combustor, and were easily oxidizable, then substantial gains could be achieved in terms of the range of the aircraft, or the weight of the payload which would be carried, since the combustion of the additive would be a much more efficient process.

SUMMARY OF THE INVENTION

This invention involves a process for achieving more energetic fuels for aircraft and missiles by using a substantial amount of high density fullerenes and selected from the group consisting of high density fullerenes, fullerene derivatives in amounts from about 25 weight percent to about 50 weight percent, mixed with liquid hydrocarbon fuels in amounts from about 75 weight percent to about 50 weight percent. A gel rheology additive such as ethyl cellulose is added in amounts of about 2 weight percent. The high density fullerenes and fullerene derivatives and mixtures thereof have cage structures comprising $C_{60}$ and $C_{70}$ fullerenes.

The advantages of the these materials are that they constitute a form of high density carbon which will evaporate or sublime quite easily by comparison to particles of carbon. The fullerenes, or derivatives of fullerenes, exist as molecules which are relatively volatile. These materials are generally solids and therefore easily compounded into hydrocarbon fuels slurries. If desired the derivatives can be tailored for high solubility in hydrocarbon solvents. In addition, the fullerenes can be modified easily to adjust the oxidization susceptibility so that the residence time in the combustion zone can be shortened even further.

DESCRIPTION OF THE PREFERRED EMBODIMENTS

The high density, energetic fuels of this invention are comprised of a hydrocarbon or hydrocarbon derivative carrier such as jet fuel, and fullerenes or fullerene derivatives having a cage structure of $C_{60}$ and $C_{70}$ fullerenes and mixtures thereof.

The fullerenes used in this invention would include the parent members of the series, as well as members of three other classes of derivatives; 1) fullerenes with easily oxidizable groups attached; 2) fullerenes with oxidizing groups attached; 3) fullerenes with hydrocarbon or substituted hydrocarbon groups attached. Using the $C_{60}$ fullerene as an example, easily oxidizable groups may be attached to the fullerene in order to facilitate its combustion. Examples of easily oxidizable groups are alkene, acetylenic, alcohol, amine, hydrazine, mercaptan, sulfide, disulfide, or aldehyde groups.

A second class of fullerene derivatives is illustrated by fullerenes which have oxidizing groups attached such as nitro, nitrate, azide, chlorate, perchlorate, or peroxy.

A third class of fullerene derivatives is a class in which hydrocarbon or substituted hydrocarbon groups are used to achieve various characteristics such as solubility in the hydrocarbon carrier, low freezing point, rheological characteristics, and density. Examples of this type of group include straight chain or branched hydrocarbons as well as those including nitrogen, oxygen, or sulfur atoms.

EXAMPLE I

Preparation of Fuel Gel Slurries

A fuel gel slurry is prepared by adding a mixture of the C60 and C70 fullerenes in an 85 weight percent to 15 weight percent ratio to a hydrocarbon base carrier jet fuel (e.g., JP 10). To the fuel gel slurry a gel rheology additive of ethyl cellulose of about 2.0 weight percent is added.

EXAMPLE II

Preferred Embodiments of Fullerenes in Mixture with Hydrocarbon Base Jet Fuel A preferred embodiment which showed good flow properties is a fuel gel containing 45 weight percent of the C60/C70 mixture, 55 weight percent hydrocarbon base carrier fuel, and a 2.0 weight percent gel rheology additive of ethyl cellulose.

The use of fullerenes in mixture with the hydrocarbon base fuel because of their relatively volatility, low molecular weight compared to particulates, and high density compared to other organic solids, results in a more energetic fuel for combustion. The primary advantage of course is the greater density of the fuel which is translatable into energy useful for a greater range and/or greater payload.

While the present invention has been described by specific embodiments thereof, it should not be limited thereto, since obvious modification will occur to those skilled in the art without departing from the spirit of the invention or the scope of the following claims.

I claim:

1. A high energy fuel comprising an admixture of a hydrocarbon base carrier fuel and solid fuel fullerenes selected from the group consisting of solid fuel, high density fullerenes having a cage structure and derivatives of solid fuel, high density fullerenes having a cage structure, said high energy fuel comprising an admixture of said hydrocarbon base carrier fuel in an amount from about 75 weight percent to about 50 weight percent and said solid, high density fullerenes in an amount from about 25 weight percent to about 50 weight percent.

2. The high energy fuel defined in claim 1 wherein said derivatives of solid fuel fullerenes have an easily oxidizable group attached to said fullerenes in order to facilitate its combustion, said easily oxidizable group selected from the easily oxidizable groups consisting of alkene, acetylenic, alcohol, amine, hydrazine, mercaptan, sulfide, disulfide, and aldehyde.

3. The high energy fuel as defined in claim 1 wherein said derivatives of solid fuel fullerenes have oxidizing groups attached to said fullerenes in order to facilitate its combustion, said oxidizing groups selected from the oxidizing groups consisting of nitro, nitrate, azide, chlorate, perchlorate, and peroxy.

4. The high energy fuel as defined in claim 1 wherein said derivatives of solid fuel fullerenes have hydrocarbon or substituted hydrocarbon groups attached to said fullerenes in order to achieve various improved characteristics of said admixture which include improved solubility of said additive in the hydrocarbon carrier, lowering of freezing point, improved rheological characteristics, and increased density, said hydrocarbon or substituted hydrocarbon group selected from the group consisting of hydrocarbon or substituted hydrocarbon groups having straight chain hydrocarbon or branched chain hydrocarbon which may include nitrogen, oxygen, or sulfur atoms as part of said straight or branched chain hydrocarbon.

5. The high energy fuel as defined in claim 1 wherein said high energy fuel additionally comprises about 2 weight percent of a gel rheology additive of ethyl cellulose.

6. The high energy fuel as defined in claim 5 wherein said solid fuel, high density fullerenes are in the form of a fuel gel slurry prepared by adding a mixture of $C_{60}$ and $C_{70}$ fullerenes in an 85 weight percent to about 15 weight percent ratio to said hydrocarbon base carrier fuel.

7. The high energy fuel as defined in claim 6 comprising about 45 weight percent of said mixture of $C_{60}$ and $C_{70}$ fullerenes, and about 55 weight percent hydrocarbon base carrier fuel.

* * * * *